United States Patent [19]

Aldinger et al.

[11] 4,030,405

[45] June 21, 1977

[54] RADIAL PISTON MACHINE

[75] Inventors: Ulrich Aldinger; Günter Kersten, both of Stuttgart, Germany

[73] Assignee: Robert Bosch G.m.b.H., Stuttgart, Germany

[22] Filed: Sept. 21, 1973

[21] Appl. No.: 399,724

[30] Foreign Application Priority Data

Nov. 9, 1972 Germany ..... 2254752

[52] U.S. Cl. ..... 92/58; 92/72; 92/148; 92/223; 308/DIG. 8

[51] Int. Cl.[2] ..... F01B 13/06

[58] Field of Search ..... 92/12.1, 55, 58, 169, 92/72, 148, 223; 308/DIG. 8

[56] References Cited

UNITED STATES PATENTS

| | | | |
|---|---|---|---|
| 1,856,272 | 5/1932 | Summers | 92/223 |
| 2,599,609 | 6/1952 | Carey | 92/58 X |
| 3,069,209 | 12/1962 | Bauer | 92/169 X |
| 3,187,681 | 6/1965 | Firth et al. | 92/169 X |
| 3,318,515 | 5/1967 | Jones | 92/169 X |
| 3,476,020 | 11/1969 | Fangman | 92/169 |
| 3,620,137 | 11/1971 | Prasse | 92/169 |
| 3,727,524 | 4/1973 | Nishiyama et al. | 92/169 |

FOREIGN PATENTS OR APPLICATIONS

| | | | |
|---|---|---|---|
| 649,723 | 9/1928 | France | 92/169 |
| 224,541 | 2/1925 | United Kingdom | 92/169 |

*Primary Examiner*—Martin P. Schwadron
*Assistant Examiner*—Abraham Hershkovitz
*Attorney, Agent, or Firm*—Michael J. Striker

[57] ABSTRACT

The invention relates to an improvement in a radial piston machine having a stationary member, a cylinder body rotatable about the stationary member and having cylinder bores, pistons reciprocable in the cylinder bores, a piston-control ring adjacent the cylinder body, and glide shoes on the pistons and in sliding engagement with the control ring. According to the improvement the member and the pistons are of case-hardened steel, the cylinder body is of alloyed pearlitic cast iron, and the control ring is of steel.

12 Claims, 2 Drawing Figures

RADIAL PISTON MACHINE

BACKGROUND OF THE INVENTION

The present invention relates generally to a radial piston machine, and more particularly to an improvement in the components of a radial piston machine.

Radial piston machines are so well known as to their general construction and operation that a detailed resume thereof is not required in the context of this disclosure. However, it is necessary to point out that such radial piston machines generally utilize a stationary member, a cylinder body which rotates about the stationary member and is provided with cylinder bores, pistons which are reciprocably guided in these bores, a piston-control ring which is adjacent the cylinder body, and glide shoes provided on the pistons and in sliding engagement with the control ring. According to the prior art it has been proposed to provide the relatively movable surfaces of these various components in a radial piston machine, surfaces which are of course subjected to a high degree of wear, with a glide layer which may be of bronze or brass. Of course, the application of such a layer requires a considerable increase in the complexity of manufacturing the radial piston machine and, thus, in the expenses of manufacture. Moreover, it has been found that the materials proposed for these glide layers are not capable of withstanding the high pressures which frequently obtain in the radial piston machines now in use. Moreover, there are also certain circumstances in which the copper contained in the materials proposed for the glide layer may react chemically (and deleteriously) with the fluid medium being pumped, if the radial piston machine is used as a pump.

SUMMARY OF THE INVENTION

It is, accordingly, an object of the present invention to overcome the disadvantages of the prior art.

More particularly, it is an object of the present invention to provide an improvement in a radial piston machine of the type outlined above, which improvement will avoid the aforementioned disadvantages.

Still more particularly it is an object of the present invention to provide the aforementioned improvement in terms of proposing a combination of materials for the various components of the piston machine, the characteristics of which materials make it possible to employ the improved radial piston machine with all types of media and even at the highest pressures.

An additional object of the invention is to provide such an improved radial piston machine which can be produced at less expense than was heretofore possible.

In keeping with the above objects, and with others which will become apparent hereafter, one feature of the invention resides, briefly stated, in a radial piston machine of the type having a stationary member, a cylinder rotatable about the stationary member and having cylinder bores, pistons reciprocable in the cylinder bores, a piston-control ring adjacent the cylinder body, and glide shoes on the pistons and in sliding engagement with the control ring. In such a radial piston machine, the present invention resides in an improvement according to which the stationary member and the pistons are of case-hardened steel, the cylinder body is of alloyed pearlitic cast iron, and the control ring is of steel.

This construction not only meets the above requirements in terms of avoiding the disadvantages of the prior art, but permits a reduction in the manufacturing expense.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
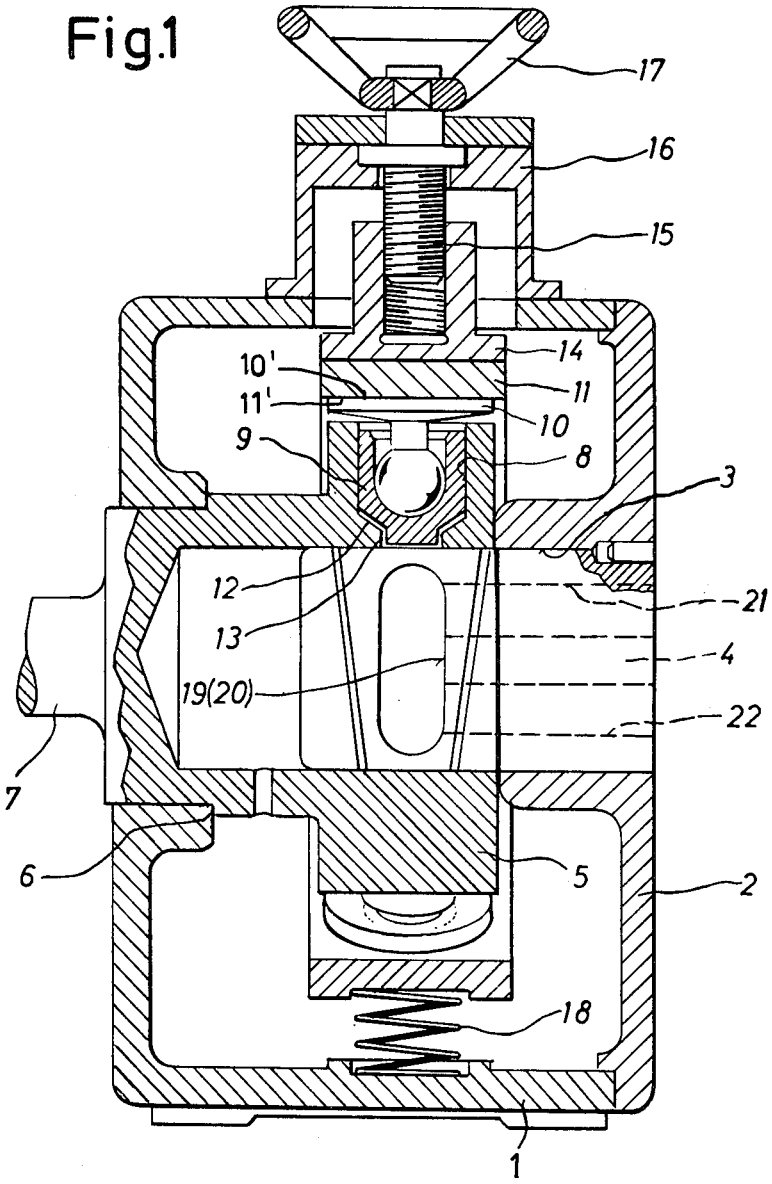
FIG. 1 is a longitudinal section through a radial piston machine according to the present invention.

Discussing the drawing now in detail, and referring firstly to FIG. 1, it will be seen that the radial piston machine illustrated therein has a housing 1 having an open side which is closed by a cover 2. The cover 2 is provided with a bore 3 in which a stationary pin or member 4 is fixedly mounted. A cylinder body 5 is turnably mounted on the member 4 and has a surface 6 which engages a cooperating surface provided on the housing 1.

A shaft portion 7 is formed on the cylinder body 5 and serves as an input shaft for driving the cylinder body 5 if the radial piston machine is used as a pump, and as an output shaft for transmitting motion to a component to be driven if the radial piston machine is used as a motor.

The cylinder body 5 is provided with a plurality of radial cylinder bores 8 which are stepped and each of which accommodates a piston 9 in sealing relationship, with each piston 9 being reciprocable in the associated cylinder bore 8. Each of the pistons 9 is provided with a glide shoe 10 having a surface 10' which contacts a contact face 11' of a piston-control ring 11 which is located adjacent to the cylinder body 5, surrounding the latter. The cylinder bores 8 each have a shoulder 12 at which they merge into an opening 13.

A nut 14 is provided on the ring 11 and engages a spindle 15 which is mounted in a housing portion 16 for turning movement, being coupled with a hand wheel 17 by means of which the spindle 15 can be turned. A spring 18 acts upon the ring 11, counter to the pressure which can be exerted on the same by the spindle 15. By displacing the ring 11 radially with reference to the cylinder body 5, via appropriate rotation of the spindle 15, the stroke of the pistons 9 can be varied at the will of an operator.

The member 4 is provided with two slot-like openings 19 and 20 which are diametrally opposite and which cooperate with the outlets 13 of the cylinder bores 8. These openings 19 and 20 extend in a circumferential direction of the member 4 and each communicate with a bore 21 and 22 for the inlet and outlet of pressure fluid.

The components 9 and 5, 5 and 4, 9 and 10, and 10 and 11 respectively cooperate with one another. It is these components which are subjected to high wear due to their sliding cooperation. In contradistinction to the prior art, all of these components of the radial piston machine according to the present invention are made of ferritic materials.

More particularly, the member 4 may according to the invention be advantageously of case-hardened steel, the cylinder body 5 of heat treated and subsequently nitrided low-alloyed pearlitic cast iron, the pistons 9 of case-hardened steel, the glide shoes 10 of low-alloyed nitrided pearlitic cast iron, and the ring of heat-treated and subsequently nitrided steel. It has been found that these materials, especially when subjected to the heat treatment mentioned above, produce optimum characteristics with respect to hardness, glide characteristics, neutral behavior with respect to all media to be pumped, and resistance to seizing. This assures that the radial piston machine according to the present invention will have a long life span and will be highly reliable in its operation.

For manufacturing reasons it has been found that, if the elements 4, 10, 5, 9 and 11 are each of one and the same material throughout, it is advantageous that the respective element is subjected to the aforementioned heat treatment in toto. Of course, by appropriate shielding or masking it is also conceivable to heat-treat only the glide surfaces of the respective elements, but it is generally simpler to heat treat the entire element.

It would also be possible to manufacture the aforementioned elements of different materials than those outlined above, and to produce sleeves (either surrounding the elements or inserted, depending upon where the glide surfaces to be located) which are made of the materials outlined above as suitable. Under particularly difficult circumstances, especially if the medium or media to be pumped do not have lubricating characteristics, it has been found advantageous if the contact face 11' of the ring 11 and/or the surface 10' of the respective glide shoes 10 is provided with an initial wear coating of cadmium, silver or lead, having a thickness of approximately 15 micron. This coating gradually wears away during the operation of the piston machine.

Another advantageous combination of materials for the aforementioned components can utilize case-hardened steel for the component 4, heat-treated low-alloyed pearlitic cast iron for the component 5, case-hardened steel for the components 9, nitrided steel for the components 10 and case-hardened steel for the component 11.

In this embodiment the elimination of the nitriding step of some of the components makes it unnecessary to subject these components to a re-working operation to compensate for the dimensional changes which take place during the nitriting operation.

The glide shoes 10 could also be produced of sintered metal, that is by sintering of nitrided steel or nitrided low-alloy pearlitic cast iron. This would further reduce the manufacturing expenses for this relatively complicated component. The hardening operation remains unchanged if sintering is resorted to, but can be limited to include only the glide surfaces, as mentioned before.

In this combination of materials it may also be advantageous to provide various ones of the cooperating glide surfaces with a wear layer of cadmium, silver or lead possibly including a negligible amount of copper, for the reasons mentioned earlier.

It is, of course, possible to combine various of the materials of the two groups outlined above.

Figure 2:
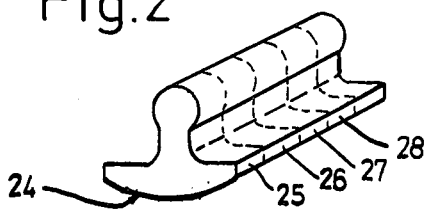
FIG. 2 illustrates a profiled blank for use in making glide shoes for the piston machine of FIG. 1.

The glide shoes 10 can be produced particularly advantageously and at economically attractive cost, if one uses as the starting material for their manufacture a rod-shaped profile 24, as shown in FIG. 2. Portions or lengths 25, 26, 27, 28 are severed from this profile 24 and are then subjected to the further steps which convert these lengths into the glide shoes 10. The profile 24 can be produced by a non-cutting manufacturing method which is less expensive than if a cutting operation or material-removing shaping operation is required, for instance by means of casting or rolling, drawing or the like.

The glide shoes 10 may be produced of steel which is capable of being nitrided but which has not been so treated until the glide shoes have been produced, whereupon the glide shoes are then subjected to nitriding. The glide shoes and/or the ring 11, or else their cooperating surfaces, may advantageously be salt bath nitrided.

It will be understood that each of the elements described above, or two or more together, may also find a useful application in other types of constructions differing from the types described above.

While the invention has been illustrated and described as embodied in a radial piston machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A radial piston machine, comprising a stationary member; a cylinder body mounted on said stationary member for rotation with respect thereto and having a plurality of cylinder bores bounded by internal surfaces, said stationary member and said cylinder body having neighboring contact regions of case-hardened steel and alloyed pearlitic iron, respectively, in sliding contact with one another; pistons mounted in said cylinder bores for reciprocation therein and having external surfaces in sliding contact with said internal surfaces, said pistons and said cylinder body having portions of case-hardened steel and alloyed pearlitic iron, respectively, defining said external and internal surfaces; a piston-control ring of steel adjacent said cylinder body; and glide shoes on said pistons and in sliding contact with said piston-control ring.

2. A radial piston machine as defined in claim 1, wherein said glide shoes are of sintered metal.

3. A radial piston machine as defind in claim 1, wherein said glide shoes are or alloyed pearlitic cast iron.

4. A radial piston machine as defined in claim 1, wherein said glide shoes are of nitrited steel.

5. A radial piston machine as defined in claim 1, said bores being bounded by inner surfaces and said cylinder body having slide surfaces, and said control ring having a contact face on which said glide shoes slide; and wherein said inner and slide surfaces are heat treated and at least said face is heat treated and nitrited.

6. A radial piston machine as defined in claim 5, wherein said inner and slide surfaces are also nitrited and said face is salt bath nitrited.

7. A radial piston machine as defined in claim 1, said bores being bounded by inner surfaces and said cylinder body having slide surfaces, and said control ring having a contact face on which said glide shoes slide; and wherein said inner and slide surfaces are heat treated, and at least said face is case hardened.

8. A radial piston machine as defined in claim 1, wherein said glide shoes are nitrited.

9. A radial piston machine as defined in claim 1, wherein said glide shoes are salt both nitrited.

10. A radial piston machine as defined in claim 1, wherein said cylinder body is of low-alloy pearlitic cast iron.

11. A radial piston machine as defined in claim 1, said glide shoes and said control ring having respective cooperating contact faces; and wherein said contact faces are provided with a slide-promoting coating.

12. A radial piston machine as defined in claim 11, wherein said coating is selected from the group composed of cadmium, silver and lead.

* * * * *